US009895009B2

(12) United States Patent
Crouch

(10) Patent No.: US 9,895,009 B2
(45) Date of Patent: Feb. 20, 2018

(54) STORAGE BLANKET FOR USE WITH A BABY PACIFIER

(71) Applicant: Patricia Gutierrez Crouch, Pasadena, CA (US)

(72) Inventor: Patricia Gutierrez Crouch, Pasadena, CA (US)

( * ) Notice: Subject to any disclaimer, the term of this patent is extended or adjusted under 35 U.S.C. 154(b) by 332 days.

(21) Appl. No.: 14/809,002

(22) Filed: Jul. 24, 2015

(65) Prior Publication Data

US 2017/0020309 A1 Jan. 26, 2017

(51) Int. Cl.
*A47G 9/00* (2006.01)
*A47G 9/02* (2006.01)

(52) U.S. Cl.
CPC ..... *A47G 9/0223* (2013.01)

(58) Field of Classification Search
CPC ..... A47G 9/02; A47G 9/0207; A47G 9/0223; A47G 9/0238
See application file for complete search history.

(56) References Cited

U.S. PATENT DOCUMENTS 4,604,758 A * 8/1986 Grasberger ..... A41B 13/10 2/49.3
5,131,096 A * 7/1992 Olson ..... A41D 11/00 2/69
5,522,849 A 6/1996 Xiques et al.
5,988,742 A * 11/1999 Stevens ..... A47D 15/006 2/69.5
6,199,232 B1 * 3/2001 Kocivar ..... A47G 9/0207 2/69.5
6,269,502 B1 8/2001 Exstrom
6,564,403 B1 * 5/2003 Titus ..... A47D 15/008 5/424
7,587,769 B1 * 9/2009 McDermott ..... A41B 13/06 2/69
8,745,794 B1 * 6/2014 McDermott ..... A41B 13/06 2/69.5
2003/0131411 A1 * 7/2003 Gibson ..... A41B 13/06 5/482
2006/0282953 A1 * 12/2006 Telegadis ..... A47D 15/003 5/655
2008/0134432 A1 * 6/2008 Brandon ..... A47G 9/0223 5/482
2009/0077750 A1 * 3/2009 Jarvis ..... A45C 9/00 5/639
2009/0158527 A1 * 6/2009 Skophammer ..... A45C 9/00 5/655

(Continued)

*Primary Examiner* — David E Sosnowski
(74) *Attorney, Agent, or Firm* — Mark H. Plager

(57) ABSTRACT

A storage blanket for use by a user to store a pacifier minimizes contamination to the pacifier and effort by the user. The storage blanket includes a flexible base sheet having a front side and a back side, a second flexible sheet mechanically coupled to edges of the front side of the flexible base sheet to create a pocket, the second flexible sheet being positioned to create an exposed portion on the front side of the base sheet, a first fastener coupled to a corner region of the exposed portion, and a second fastener coupled to the corner region of the exposed portion proximate the first fastener. The corner region is designed to fold around a ring of the pacifier to permit the first fastener to engage with the second fastener to secure the pacifier. The secured pacifier can be inserted into the pocket.

4 Claims, 4 Drawing Sheets

(56) References Cited

U.S. PATENT DOCUMENTS

| | | | | |
|---|---|---|---|---|
| 2010/0050341 | A1* | 3/2010 | Tepper | A47G 9/0261 5/488 |
| 2010/0263122 | A1* | 10/2010 | Papen | A47D 15/003 5/502 |
| 2010/0275373 | A1* | 11/2010 | Kaplan | A47D 15/008 5/494 |
| 2011/0224730 | A1 | 9/2011 | Holley | |
| 2013/0192000 | A1* | 8/2013 | Posner | A47D 15/00 5/658 |
| 2014/0068859 | A1* | 3/2014 | Alegria | A47D 1/00 5/424 |
| 2016/0347220 | A1* | 12/2016 | Brown | A47G 9/068 |

* cited by examiner

FIG.1
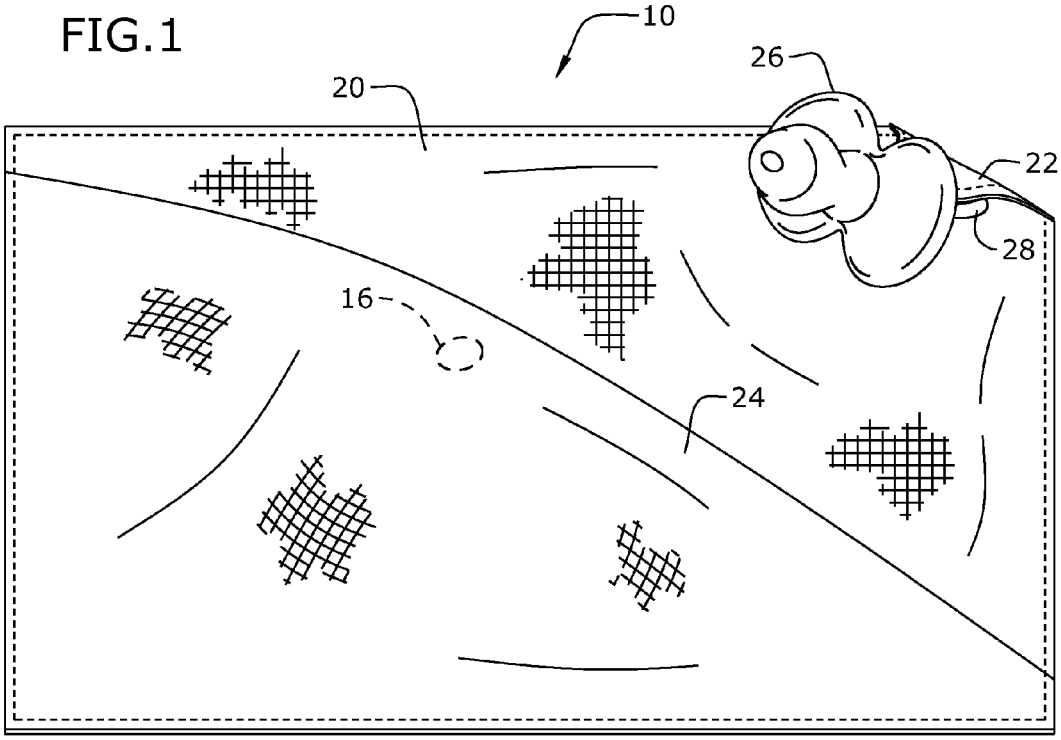
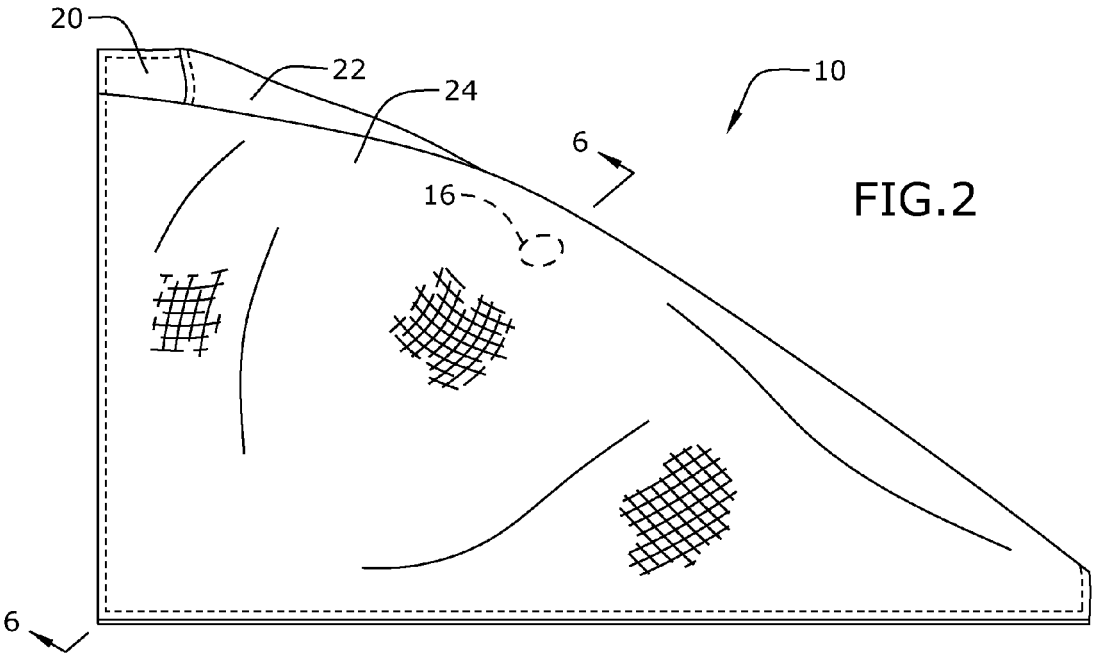
FIG.2

FIG.3
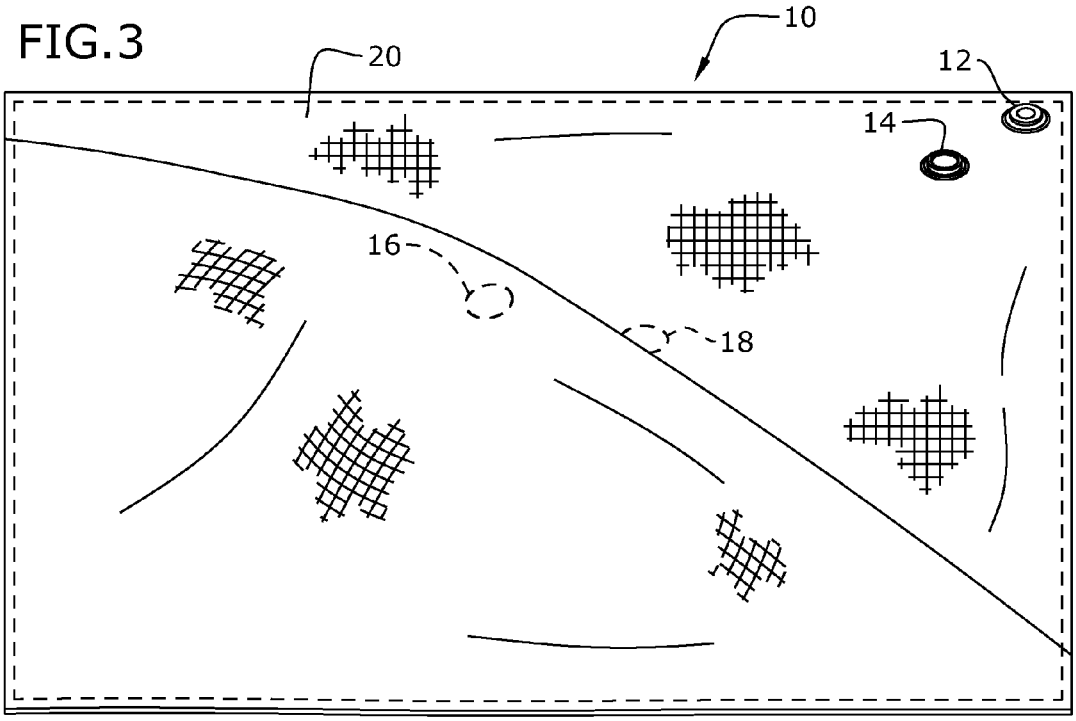
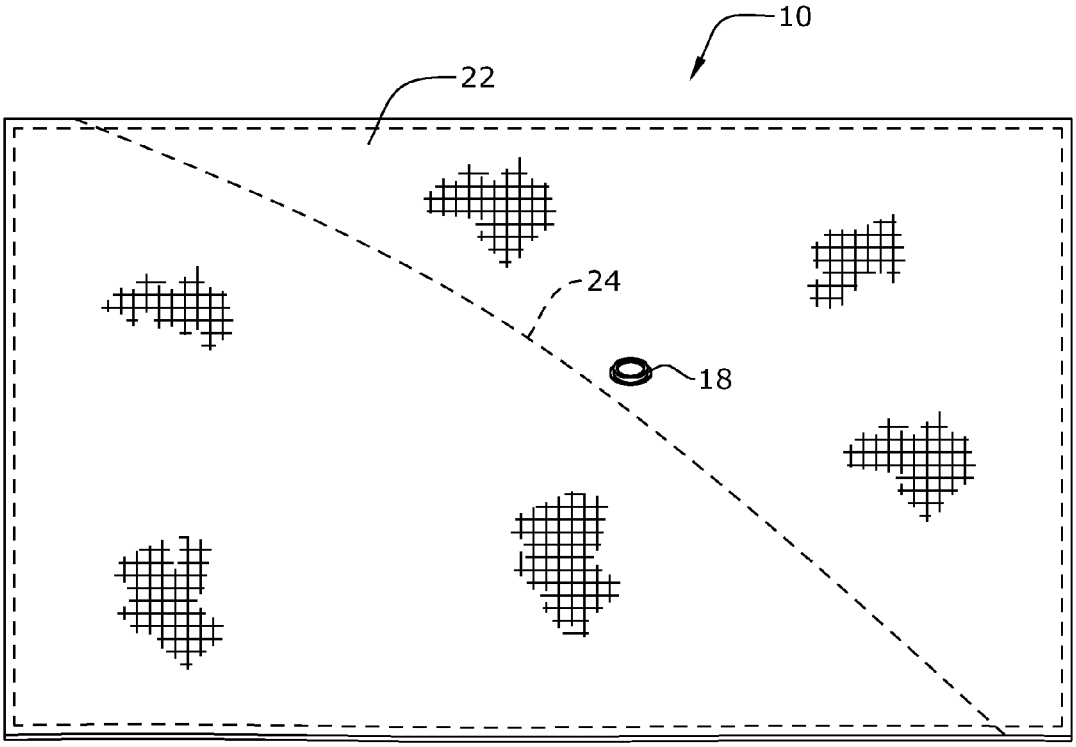
FIG.4

STORAGE BLANKET FOR USE WITH A BABY PACIFIER

BACKGROUND

The embodiments herein relate generally to devices for attaching and storing pacifiers.

Pacifiers typically are rubber or plastic nipples used by babies to chew or suck on. This produces a soothing or calming effect on the baby. Since pacifiers are relatively small devices that are easy to misplace or lose, there is the need to properly store these devices for an easy retrieval. In addition, there is the need to keep the pacifier in a sanitary condition since the device is placed within the mouth of the baby.

Several pacifier securement devices are disclosed in U.S. Pat. Nos. 5,522,849 and 6,269,502, and U.S. Patent Application Publication 2011/0224730. These publications disclose pacifiers that are secured to either a cloth or blanket member, or holder. However, in these configurations, the pacifier is exposed to the environment and can be easily contaminated.

As such, there is a need in the industry for a storage blanket that effectively stores a pacifier and permits a user to easily fold the blanket over to prevent the pacifier from being contaminated. In addition, there is a need for the storage blanket to permit a baby to use the pacifier and snuggle with the blanket at the same time.

SUMMARY

A storage blanket for use by a user to store a pacifier is provided. The storage blanket is configured to enclose the pacifier with enhanced efficiency to minimize contamination to the pacifier and effort by the user. The storage blanket comprises a flexible base sheet comprising a front side and a back side, a second flexible sheet mechanically coupled to edges of the front side of the flexible base sheet to create a pocket defined by space between the flexible base sheet and the second flexible sheet, the second flexible sheet being positioned to create an exposed portion on the front side of the base sheet, a first fastener coupled to a corner region of the exposed portion, and a second fastener coupled to the corner region of the exposed portion proximate the first fastener, wherein the corner region is configured to fold around a ring of the pacifier to permit the first fastener to engage with the second fastener to secure the pacifier thereto, wherein the secured pacifier is configured to be inserted into the pocket to enclose the pacifier.

BRIEF DESCRIPTION OF THE FIGURES

The detailed description of some embodiments of the invention will be made below with reference to the accompanying figures, wherein the figures disclose one or more embodiments of the present invention.

FIG. 1 depicts a perspective view of certain embodiments of the storage blanket shown in use in an unfolded configuration;

FIG. 2 depicts a perspective view of certain embodiments of the storage blanket shown in use in a folded configuration;

FIG. 3 depicts a top perspective view of certain embodiments of the storage blanket;

FIG. 4 depicts a bottom perspective view of certain embodiments of the storage blanket;

DETAILED DESCRIPTION OF CERTAIN EMBODIMENTS

Figure 5:
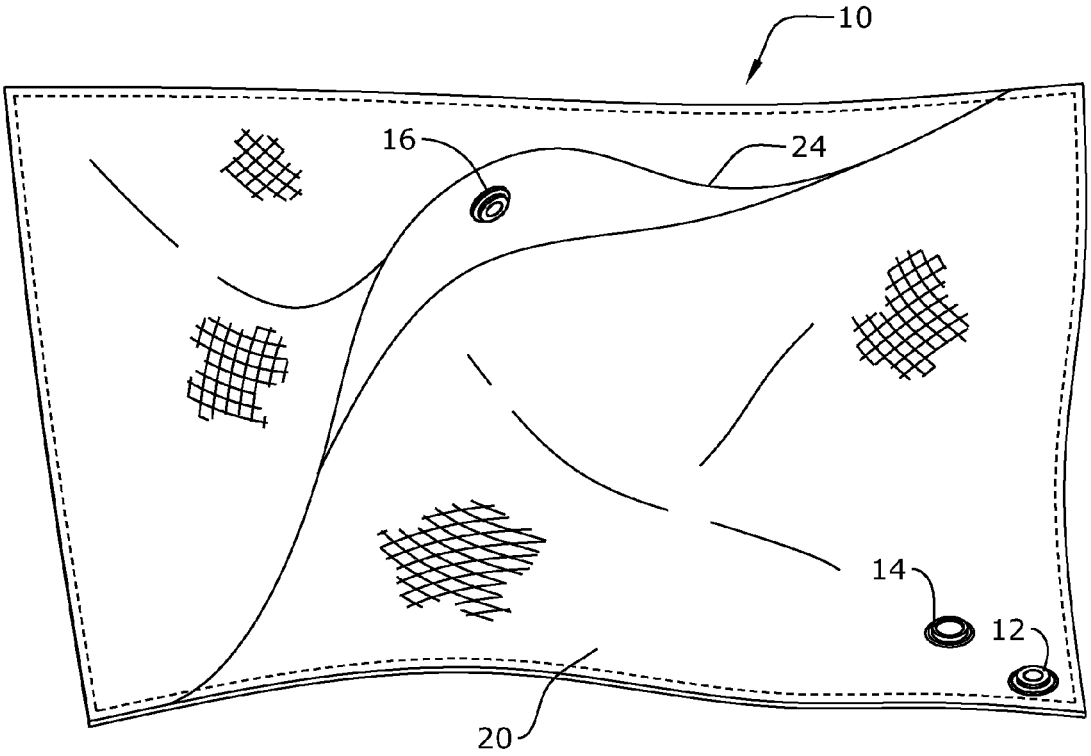
FIG. 5 depicts a perspective view of certain embodiments of the storage blanket.

As depicted in FIGS. 1-5, storage blanket 10 is configured to secure pacifier 26. Pacifier 26 may be any type of pacifier known in the field with pacifier ring 28. Storage blanket 10 comprises a generally rectangular base fabric sheet comprising front fabric side 20, back fabric side 22 and pocket 24. It shall be appreciated that the base fabric sheet may either be a single sheet or alternatively two sheets coupled together. Pocket 24 is formed by a generally triangular fabric sheet that is coupled to edges of the base fabric sheet. However, pocket 24 may be formed by a sheet having any alternative shape. The fabric sheets may be coupled together along seams on the outer edges of the sheets. In a preferred embodiment, the fabric sheets used are made from materials including, but not limited to, cotton, fleece, flannel, or the like.

Pacifier male snap fastener 12 and pacifier female snap fastener 14 are affixed to a corner region of front fabric side 20. Pocket male snap fastener 16 is affixed to the interior face of pocket 24. Pocket female snap fastener 18 is affixed to an intermediate portion on back fabric side 22. Pacifier male snap fastener 12 is configured to detachably engage with pacifier female snap fastener 14. Pocket male snap fastener 16 is configured to detachably engage with pocket female snap fastener 18. It shall be appreciated that the snap fasteners may be replaced with any alternative types of fasteners known in the field including, but not limited to, hook and loop fasteners, loop components, or the like. For example, in an alternative embodiment, a loop (not shown) can be affixed to the corner region of front fabric side 20 instead of pacifier male snap fastener 12 and pacifier female snap fastener 14. In this configuration, the loop can then be used to secure an alternative pacifier (not shown) with a slit by inserting the loop through the pacifier's slit.

Figure 6:
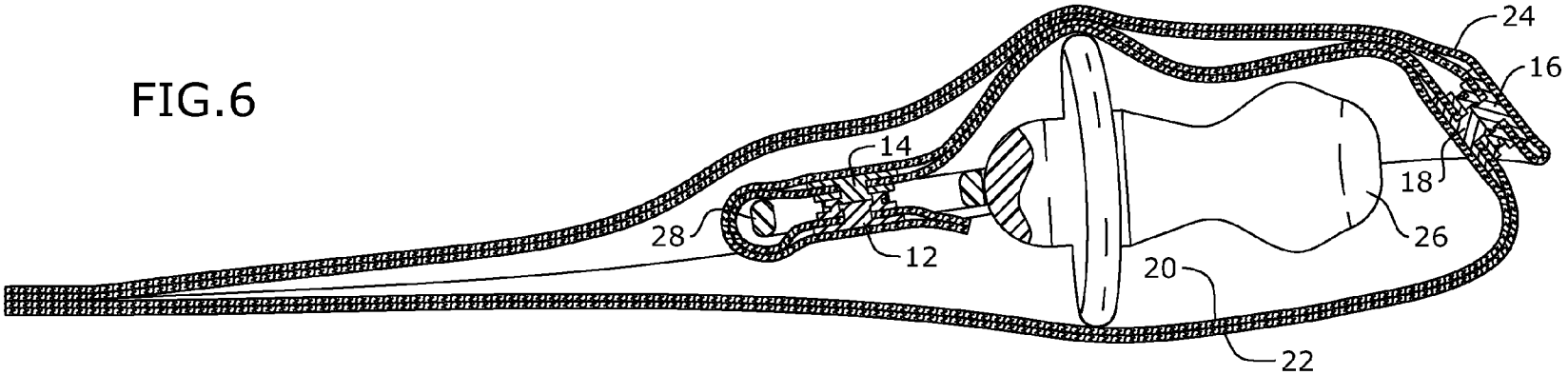
FIG. 6 depicts a section view of certain embodiments of the storage blanket taken along line 6-6 in FIG. 2.
Figure 8:
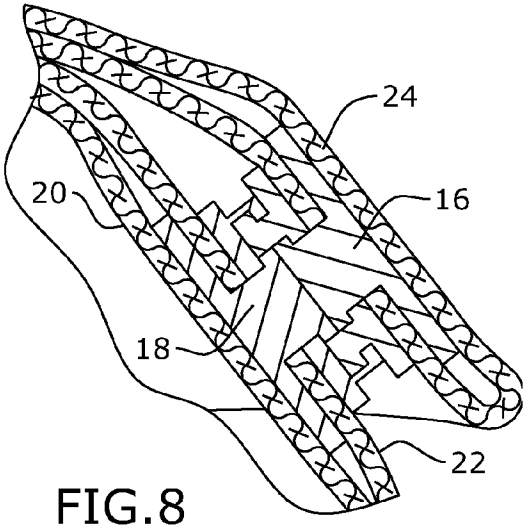
FIG. 8 depicts a section view of certain embodiments of the storage blanket.
Figure 7:
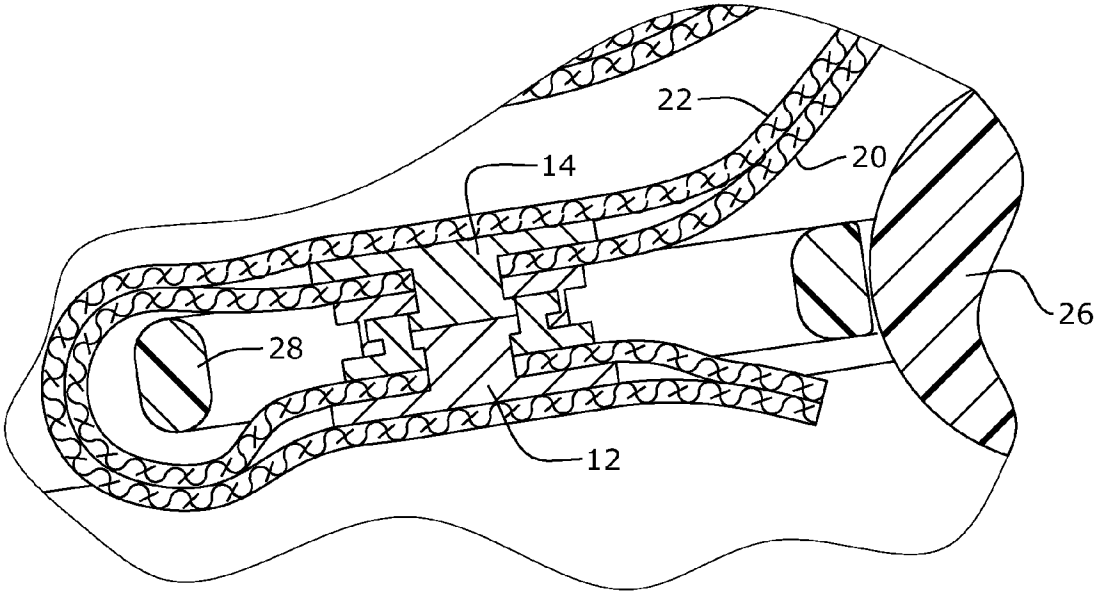
FIG. 7 depicts a section view of certain embodiments of the storage blanket.

To use storage blanket 10, the corner region of the base fabric sheet is folded around pacifier ring 28 to permit pacifier male snap fastener 12 to engage with pacifier female snap fastener 14 as shown in FIG. 1. In this configuration, a baby (not shown) can insert pacifier 26 in his/her mouth and snuggle with the fabric sheets of storage blanket 10 at the same time. To store a clean or used pacifier 26, the corner region of the base fabric sheet is folded and tucked into pocket 24 as shown in FIGS. 2 and 6. This completely encloses pacifier 26 and prevents its exposure to the outside environment, thereby minimizing the chance pacifier 26 becomes contaminated with bacteria or other pathogens. In this folded configuration, back fabric side 22 can be pressed against the interior of pocket 24 to permit pocket male snap fastener 16 to engage with pocket female snap fastener 18. This helps to maintain pacifier 26 enclosed and stored within pocket 24. FIG. 7 depicts a section view illustrating the engagement of pacifier male snap fastener 12 and pacifier female snap fastener 14 within pacifier ring 28. FIG. 8 depicts a section view illustrating the engagement of pocket male snap fastener 16 and pocket female snap fastener 18.

Pocket male snap fastener 16 can be easily disengaged from pocket female snap fastener 18 to permit a user to untuck pacifier 26 outside of pocket 24 for use. Similarly, pacifier male snap fastener 12 can be easily disengaged from pacifier female snap fastener 14 to separate pacifier 26 from storage blanket 10. This is beneficial to permit a user to clean and/or dry the components separately as needed.

It shall be appreciated that the components of storage blanket 10 described in several embodiments herein may comprise any alternative known materials in the field and be of any color, size and/or dimensions. It shall be appreciated that the components of storage blanket 10 described herein may be manufactured and assembled using any known techniques in the field. Although storage blanket 10 has been described for use with pacifier 26, the blanket may be beneficial in other applications or uses. For example, support blanket 10 may be secured to other items such as loops on water bottles, wheel chairs, baby carriers, or the like.

Persons of ordinary skill in the art may appreciate that numerous design configurations may be possible to enjoy the functional benefits of the inventive systems. Thus, given the wide variety of configurations and arrangements of embodiments of the present invention the scope of the invention is reflected by the breadth of the claims below rather than narrowed by the embodiments described above.

What is claimed is:

1. A storage blanket for use by a user to store a pacifier, the storage blanket configured to enclose the pacifier with enhanced efficiency to minimize contamination to the pacifier and effort by the user, the storage blanket comprising:

a flexible base sheet having a first shape and comprising a front side and a back side;

a second flexible sheet having a second shape other than the first shape and mechanically coupled to edges of the front side of the flexible base sheet to create a pocket defined by space between the flexible base sheet and the second flexible sheet sufficiently large to receive the pacifier therein, the second flexible sheet extending partially over the front side of the base sheet and positioned to create an exposed portion on the front side of the base sheet located outside a perimeter of the second flexible sheet, the exposed portion of the base sheet defining a surface area equal to approximately half of a total surface area defined by the front side of the base sheet;

a first fastener directly coupled to a corner region of the exposed portion; and a second fastener directly coupled to the corner region of the exposed portion proximate the first fastener;

wherein the corner region is configured to fold around a ring of the pacifier to permit the first fastener to engage with the second fastener to secure the pacifier thereto, wherein the secured pacifier is configured to be inserted into the pocket to enclose the pacifier.

2. The storage blanket of claim 1, further comprising a third fastener directly coupled to the second flexible sheet within the pocket.

3. The storage blanket of claim 2, further comprising a fourth fastener directly coupled to the back side of the flexible base sheet, wherein the fourth fastener is configured to engage with the third fastener when the pacifier is enclosed within the pocket.

4. The storage blanket of claim 3, wherein the first and third fasteners are male snap fasteners, wherein the second and fourth fasteners are female snap fasteners.

* * * * *